US005514261A

United States Patent [19]

Herklotz et al.

[11] Patent Number: 5,514,261

[45] Date of Patent: May 7, 1996

[54] ELECTROPLATING BATH FOR THE ELECTRODEPOSITION OF SILVER-TIN ALLOYS

[75] Inventors: Günter Herklotz, Bruchköbel; Thomas Frey, Hanau; Wolfgang Hempel, Friedberg, all of Germany

[73] Assignee: W. C. Heraeus GmbH, Hanau, Germany

[21] Appl. No.: 380,066

[22] Filed: Jan. 30, 1995

[30] Foreign Application Priority Data

Feb. 5, 1994 [DE] Germany ..... 44 03 601.9
Nov. 10, 1994 [DE] Germany ..... 44 40 176.0

[51] Int. Cl.[6] ..... C25D 3/56; C25D 3/60; C09D 5/00; C23C 16/00

[52] U.S. Cl. ..... 205/238; 205/252; 205/253; 205/254; 106/123; 106/126

[58] Field of Search ..... 205/238, 252, 205/253, 254; 106/1.12, 1.13, 1.19, 1.22, 1.23, 1.25, 1.26

[56] References Cited

U.S. PATENT DOCUMENTS 4,246,077 1/1981 Hradil et al. ..... 204/43 R
4,399,006 8/1983 Nobel et al. ..... 205/170
4,582,576 4/1986 Opaskar et al. ..... 204/44.4

FOREIGN PATENT DOCUMENTS 718252 3/1942 Germany .
849787 9/1952 Germany .
1153587 8/1963 Germany .
1960047 11/1970 Germany .

*Primary Examiner*—John Niebling
*Assistant Examiner*—Edna Wong
*Attorney, Agent, or Firm*—Frishauf, Holtz, Goodman, Langer & Chick

[57] ABSTRACT

Silver-tin alloys can be deposited by the galvanic method from a cyanide-free bath which is prepared using silver as the nitrate or diammine complex, tin as the soluble tin(II) or tin(IV) compound and mercaptoalkane-carboxylic acids and -sulfonic acids, Uniform and adhering coatings of silver-tin alloys with a silver content of approximately 20 to 99 weight % can be deposited from said bath. Silver-tin alloys are electrodeposited from said bath at a pH of 0 to 14 and a current density of 0.1 to 10 A/dm$^2$.

16 Claims, No Drawings

ELECTROPLATING BATH FOR THE ELECTRODEPOSITION OF SILVER-TIN ALLOYS

FIELD OF THE INVENTION

The invention relates to a bath for the electrodeposition of silver-tin alloys containing silver as a soluble silver compound, tin as a soluble tin compound and a complexing agent.

BACKGROUND

German Patent No. 718 252 relates to a process for producing electrodeposited coatings of silver-tin alloys with a tin content of 5 to 20%, employing an alkaline cyanide bath containing tin in the form of stannate or tetrachloride and current densities of 0.1 to 1 a/dm$^2$. The baths may also additionally contain potassium gold cyanide and/or palladium chloride; in this case silver-tin alloys with 2 to 20% gold and/or palladium are deposited.

German Patent No. 849 787 proposes oxyacids, amino acids or salts of these acids as complexing agents suitable for the electrodeposition of alloys of silver with germanium, tin, arsenic or antimony from cyanidic electrolytes. The deposited coatings are hard and are distinguished by high luster, because of which the subsequent polishing is made easier even with thick deposits. It is not possible to cite general threshold values for the addition of germanium, tin, arsenic or antimony, since they are subject to strong fluctuations in connection with the composition of the baths and the working conditions. It is possible to add brighteners to the baths; however, the effects remain weak in general.

German Laid-Open Patent Application No. 1 153 587 discloses a cyanide bath for the electrodeposition of alloys in which the silver is in the form of potassium silver cyanide and which contains the alloy elements—mainly tin, lead, antimony and bismuth—in the form of complexes with an aromatic dihydroxy compound. The bath is operated at a current density of 0.5 to 1.5 A/dm$^2$ and at room temperature. The current density can be increased to more than 2 A/dm$^2$ by the addition of brighteners. This published application also discloses that aliphatic oxycarboxylic acids, such as oxalic acid or tartaric acid, and aliphatic, straight-chain polyoxy compounds, such as sorbitol, dulcitol or glycerol have been used as complexing agents for the deposition of alloys from cyanide silver baths.

THE INVENTION

It is an object of this invention to provide a bath for the electrodeposition of silver-tin alloys, which is free of cyanide and is stable over a wide pH range and can be operated at room temperature as well as at higher temperatures. Uniform and adherent coatings of silver-tin alloys with a tin content of up to about 80 weight % can be deposited from the bath, wherein the alloy composition at a given silver and tin concentration of the bath is relatively independent of the current density and the temperature.

The aqueous baths of the present invention have a pH of 0 to 14 and comprise 1 to 120 g/l of silver as a silver compound, 1 to 100 g/l of tin as a tin compound, 5 to 450 g/l of mercaptoalkanecarboxylic acid and/or mercaptoalkanesulfonic acid and/or their salts, and 0 to 200 g/l of at least one conductivity salt.

A preferred aqueous bath has a pH of 0 to 11 and comprises 5 to 60 g/l of silver as a silver compound, 5 to 20 g/l of tin as a tin compound, 5 to 200 g/l of mercaptoalkanecarboxylic acid and/or mercaptoalkanesulfonic acid and/or their salts, and 0 to 150 g/l of at least one conductivity salt.

Silver nitrate and silver diammine-complexes are preferred as silver compounds for the bath.

Tin(II) and tin(IV) compounds are suitable as tin compounds, in particular tin(II) halides, such as tin(II) chloride, and tin(II) sulfate, and tin(IV) halides, such as tin(IV) chloride, and stannates, such as alkali metal (preferably sodium and more preferably potassium)stannate and ammonium stannate.

Thioglycolic acid (2-mercaptoacetic acid), thiomalic acid (mercaptosuccinic acid), thiolactic acid (2-mercaptopropionic acid) and 3-mercaptopropionic acid are preferred mercaptoalkanecarboxylic acids, and 2-mercaptoethanesulfonic acid and 3-mercaptopropanesulfonic acid are preferred mercaptoalkanesulfonic acids. The mercapto acids can be used for the preparation of the bath individually or mixture thereof and as free acids and/or in the form of their salts, in particular the alkali metal and ammonium salts.

Preferred conductivity acids and conductivity salts for the bath are boric acid, carboxylic acids, hydroxy acids, and salts of these acids to the extent they are water-soluble. Particularly preferred are formic acid, acetic acid, oxalic acid, citric acid, malic acid, tartaric acid, gluconic acid, glucaric acid, glucuronic acid and salts of these acids, since these compounds also have a stabilizing effect. The conjoint use of other conductivity salts, such as ammonium nitrate, is possible.

The bath can be operated at temperatures from 20° to 70° C. and at current densities from 0.1 to 10 A/dm$^2$, preferably from 1 to 6 A/dm$^2$.

A more rapid deposition of the alloys can be achieved by increasing the current density and the bath temperature without, with a given silver and tin content of the bath, the occurrence of increased fluctuations in the composition of the deposited alloys.

Surprisingly, the bath in accordance with the invention is very stable, even if it is maintained at temperatures above room temperature, so that extended operating times are possible. The silver-tin alloys deposited from the bath are characterized by a uniform surface and good adhesiveness.

If lustrous surfaces are desired, the use of brighteners is possible. Suitable as brighteners are, for example, aldehydes, ketones, carboxylic acids, carboxylic acid derivatives, amines and their mixtures, as known from German Patent No. 32 28 911 and U.S. Pat. No. 4,582,576 in connection with tin electroplating baths. Metallic brighteners, such as known from German Laid-Open Patent Application No. 1 960 047 and U.S. Pat. No. 4,246,077, are also suitable and can be added to the bath in amounts of 50 mg/l to 5 g/l, preferably of 100 to 250 mg/l . Compounds of iron, cobalt, nickel, zinc, gallium, arsenic, selenium, palladium, cadmium, indium, antimony, tellurium, thallium, lead and bismuth have been particularly proven in connection with the bath of the invention. Polyethyleneglycols and their derivatives, preferably the polyethyleneglycol ethers, to the extent that they are water-soluble, are effective brighteners. They can be utilized as the only brighteners or also in a mixture with the aforesaid metal compounds mentioned.

The bath can be used for electroplating small parts as well as tapes and wires and makes possible the deposition of silver alloys with a tin content of up to about 80 weight %.

For the detailed explanation of the invention, baths in accordance with the invention as well as the deposition of coatings made of silver-tin alloys from them are described as follows.

DETAILED DESCRIPTION

EXAMPLE 1

A solution of water and 10 g/l silver as silver nitrate, 10 g/l tin as tin (IV)-chloride-pentahydrate, 45 g/l thiomalic acid, and 60 g/l potassium salt of D-gluconic acid is prepared; the pH value of the solution is set to 1 by means of a mixture of potassium hydroxide and ammonium hydroxide (weight ratio 1:1).

Uniform, adhering coatings of a silver-tin alloy of 55 weight % of silver and 45 weight % of tin are deposited from said bath at a bath temperature of 30° C. and a current density of 1 A/dm$^2$. The bath is stable; no precipitation takes place.

EXAMPLE 2

A solution of water and 40 g/l silver as silver nitrate, 10 g/l tin as tin(IV)-chloride-pentahydrate, 45 g/l thiomalic acid, 47 g/l thiolactic acid, and 150 g/l potassium salt of D-gluconic acid is prepared; the pH value of the solution is set to 1.9 by means of a mixture of potassium hydroxide and ammonium hydroxide (weight ratio 1:1).

Uniform, adhering coatings of a silver-tin alloy of 75 weight % of silver and 25 weigh-% of tin are deposited from said bath at a bath temperature of 60° C. and a current density of 5 A/dm$^2$. The bath is stable; no precipitation takes place.

EXAMPLE 3

A solution of water and 40 g/l silver as silver nitrate, 10 g/l tin as tin(IV)-chloride-pentahydrate, 90 g/l thiomalic acid, 26 g/l potassium citrate, and 240 mg/l arsenic trioxide is prepared; the pH value of the solution is set to 3.2 by means of a mixture of potassium hydroxide and ammonium hydroxide (weight ratio 1:1).

Uniform, adhering and lustrous coatings of an arsenic-containing silver-tin alloy of 66 weight % of silver are deposited from said bath at a bath temperature of 60° C. and a current density of 1 A/dm$^2$. The bath is stable; no precipitation takes place.

EXAMPLE 4

A solution of water and 40 g/l silver as silver nitrate, 10 g/l tin as potassium stannate, 90 g/l thiomalic acid, 26 g/l potassium citrate 25 g/l D-gluconic acid, and 240 mg/l arsenic trioxide is prepared; the pH value of the solution is set to 3.2 by means of a mixture of potassium hydroxide and ammonium hydroxide (weight ratio 1:1).

Uniform, adhering and lustrous coatings of an arsenic-containing silver-tin alloy of 67 weight % of silver are deposited from said bath at a bath temperature of 60° C. and a current density of 5 A/dm$^2$. The bath is stable; no precipitation takes place.

EXAMPLE 5

A solution of water and 10 g/l silver as silver nitrate, 30 g/l tin as potassium stannate, 14 g/l thiomalic acid, 60 g/l potassium salt of D-gluconic acid 60 g/l ammonium nitrate 10 g/l boric acid, and 200 m/l palladium as palladium diamminedinitrate is prepared; the pH value of the solution is set to 10.3 by means of potassium hydroxide.

Uniform, adhering and lustrous coatings of a palladium-containing silver-tin alloy of 81 weight % of silver are deposited from said bath at a bath temperature of a. 20° C. and b. 45° C. and a current density of 5 A/dm$^2$. The bath is stable; no precipitation takes place.

EXAMPLE 6

A solution of water and 40 g/l silver as diammine silver nitrate, 10 g/l tin as tin(IV)-chloride-pentahydrate, 58 g /l thiolactic acid, 50 g /l D-gluconic acid, 100 mg/l arsenic trioxide, and 1 g/l nickel as nickel(II)-chloride is prepared; the pH value of the solution is set to 4 by means of potassium hydroxide.

Uniform, adhering and lustrous coatings of an arsenic- and nickel-containing silver-tin alloy of 70 weight % of silver are deposited from said bath at a bath temperature of 40° C. and a current density of 4 A/dm$^2$. The bath is stable; no precipitation takes place.

EXAMPLE 7

A solution of water and 10 g/l silver as silver nitrate, 10 g/l tin as tin(II)-chloride-dihydrate, 45 g/l thiomalic acid, and 50 g/l D-gluconic acid is prepared; the pH value of the solution is set to 0.7 by means of a mixture of potassium hydroxide and ammonium hydroxide (weight ratio 1:1).

Uniform, adhering coatings of a silver-tin alloy of 20 weight % of silver are deposited from said bath at a bath temperature of 25° C. and a current density of 1 A/dm$^2$. The bath is stable; no precipitation takes place.

EXAMPLE 8

A solution of water and 40 g/l silver as silver nitrate, 10 g/l tin as tin(II)-chloride-dihydrate, 90 g/l thiomalic acid, 50 g/l D-gluconic acid, 20 mg/l arsenic trioxide, and 0.1 g/l polyethyleneglycol ether (Brij$^R$ 35, Fluka, Germany)

is prepared; the pH value of the solution is 0.3.

Uniform, adhering and lustrous coatings of an arsenic-containing silver-tin alloy of 20 weight % of silver are deposited from said bath at a bath temperature of 25° C. and a current density of 1 A/dm$_2$. The bath is stable; no precipitation takes place.

EXAMPLE 9

A solution of water and 40 g/l silver as silver nitrate 15 g/l tin as tin (IV) -chloride-pentahydrate, 84 g/l 3-mercaptopropionic acid, and 100 mg/l arsenic trioxide is prepared; the pH value of the solution is set to 7.8 by means of a mixture of potassium hydroxide and ammonium hydroxide (weight ratio 1:1).

Uniform, adhering and lustrous coatings of an arsenic-containing silver-tin alloy of 96 weight % of silver and about 4 weight % of tin are deposited from said bath at a bath temperature of 30° C. and a current density of 1 A/dm$^2$. Uniform, adhering and lustrous coatings of an arsenic-containing silver-tin alloy of 95 weight % of silver and/5 weight % of tin are deposited at a bath temperature of 30° C. and a current density of 4 A/dm$^2$. The bath is stable; no precipitation takes place.

EXAMPLE 10

A solution of water and 40 g/l silver as silver nitrate 15 g/l tin as tin(IV)-chloride-pentahydrate, and 78 g/l thioglycolic acid is prepared; the pH value of the solution is set to 7.1 by means of a mixture of potassium hydroxide and ammonium hydroxide (weight ratio 1:1).

At (i) a bath temperature of 40° C. and a current density of 1 A/dm$^2$, uniform, adhering and lustrous coatings are deposited and, at (ii) a bath temperature of 40° C. and a current density of 4 A/dm$^2$, uniform, adhering and mat coatings are deposited of a silver-tin alloy of 78 weight % of silver and 22 weight % of tin. The bath is stable; no precipitation takes place.

EXAMPLE 11

A solution as described in Example 10 is prepared and 100 mg/l arsenic trioxide is added; and the pH value of the solution is set to 7.1 by means of a mixture of potassium hydroxide and ammonium hydroxide (weight ratio 1:1).

Uniform, adhering and lustrous coatings of an arsenic-containing silver-tin alloy of 76 weight % of silver and about 24 weight % of tin are deposited from said bath at a bath temperature of 40° C. and a current density of 4 A/dm$^2$. The bath is stable; no precipitation takes place.

EXAMPLE 12

A solution of water and 40 g/l silver as silver nitrate 15 g/l tin as tin(IV)-chloride-pentahydrate, 185 g/l sodium salt as 3-mercaptopropanesulfonic acid, and 100 mg/l arsenic trioxide is prepared; the pH value of the solution is set to 7.1 by means of a mixture of sodium hydroxide and ammonium hydroxide (weight ratio 1:1).

Uniform, adhering and lustrous coatings of an arsenic-containing silver-tin alloy of 83 weight % of silver and about 17 weight % of tin are deposited from said bath at a bath temperature of 40° C. and a current density of 1 A/dm$^2$. The bath is stable; no precipitation takes place.

Various changes and modifications may be made, and features described in connection with any one of the embodiments may be used with any of the others, within the scope of the inventive concept.

We claim:

1. An aqueous bath for the electrodepostion of silver-tin alloys said aqueous bath having a pH of 0 to 14 and comprising 120 g/l of silver as a soluble silver compound, 100 g/l of tin as a soluble tin compound, 450 g/l of at least one mercapto compound selected from the group consisting of mercaptoalkanecarboxylic acids, mercaptoalkanesulfonic acids, and salts of said acids, and 0 to 200 g/l of at least one compound selected from the group consisting of conductivity acids and conductivity salts.

2. The aqueous bath of claim 1, having a pH of 0 to 11 and comprising 60 g/l of silver as a soluble silver compound, 20 g/l of tin as a soluble tin compound, 200 g/l of at least one mercapto compound selected from the group consisting of mercaptoalkanecarboxylic acids, mercaptoalkanesulfonic acids, and salts of said acids, and 0 to 150 g/l of at least one compound selected from the group consisting of conductivity acids and conductivity salts.

3. The bath of claim 2, wherein said tin compound is a tin (II) compound or a tin (IV) compound.

4. The bath of claim 3, wherein said mercapto compound is at least one selected from the group consisting of thioglycolic acid, thiomalic acid, thiolactic acid, 3-mercaptopropionic acid, 2-mercaptoethanesulfonic acid and 3-mercaptopropanesulfonic acid.

5. The bath of claim 4, wherein said silver compound is silver nitrate or a silver diammine complex.

6. The bath of claim 5, wherein said at least one compound selected from the group consisting of conductivity acids and conductivity salts present in said bath is at least one compound selected from the group consisting of boric acid, carboxylic acids, hydroxy acids and salts thereof.

7. The bath of claim 6, wherein said tin compound is at least one selected from the group consisting of tin(II)-halides, tin(II)-sulfates, tin (IV)-halides, sodium stannate, potassium stannate and ammonium stannate.

8. The bath of claim 7, wherein said at least one compound selected from the group consisting of conductivity acids and conductivity salts is selected from the group consisting of formic acid, acetic acid, oxalic acid, citric acid, malic acid, tartaric acid, gluconic acid, glucaric acid and glucuronic acid and salts thereof.

9. The bath of claim 8, which further comprises at least one hydroxide selected from the group consisting of sodium hydroxide, potassium hydroxide and ammonium hydroxide which was added to adjust the pH.

10. The bath of claim 9, wherein said silver compound is silver nitrate;

said tin compound is tin(IV) chloride-pentahydrate, potassium stannate or tin(II) chloride-dihydrate;

said mercapto compound is thiomalic acid, thiolactic acid, 3-mercaptopropionic acid, thioglycolic acid, or the sodium salt or potassium salt of 3-mercaptopropanesulfonic acid; and said at least one compound selected from the group consisting of conductivity acids and conductivity salts is boric acid, potassium salt of D-gluconic acid or, potassium citrate.

11. The bath of claim 10, which further comprises a brightener.

12. The bath of claim 11, wherein said brightener is at least one brightener selected from the group consisting of (i) a soluble compound of at least one of the metals iron, cobalt, nickel, zinc, gallium, arsenic, selenium, palladium, cadmium, indium, antimony, tellurium, thallium, lead and bismuth, (ii) a polyethyleneglycol ether, and (iii) a mixture of said at least one soluble compound (i) and a polyethyleneglycol ether (ii).

13. The bath of claim 12, wherein said brightener is polyethyleneglycol ether or arsenic trioxide.

14. The bath of claim 9, which further comprises at least one brightener selected from the group consisting of (i) at least one soluble compound selected from the group consisting of the metals iron, cobalt, nickel, zinc, gallium, arsenic, selenium, palladium, cadmium, indium, antimony, tellurium, thallium, lead and bismuth, (ii) a polyethyleneglycol ether, and (iii) a mixture of said at least one soluble compound (i) and a polyethyleneglycol ether (ii).

15. A method of electrodepositing uniform and adherent silver-tin alloy on a cathode comprising electrodepositing a silver tin alloy on said cathode from a bath of claim 2 at a current density of from 0.1 to 10 $A/dm^2$, said bath being at a temperature of from 20° to 70° C.

16. A method of electrodepositing uniform and adherent silver-tin alloy on a cathode comprising electrodepositing a silver tin alloy on said cathode from a bath of claim 10 at a current density of from 1 to 6 $A/dm^2$, said bath being at a temperature of from 20° to 70° C.

* * * * *

UNITED STATES PATENT AND TRADEMARK OFFICE

CERTIFICATE OF CORRECTION

PATENT NO. : 5,514,261

DATED : May 7, 1996

INVENTOR(S) : Gunter HERKLOTZ et al.

It is certified that error appears in the above-indentified patent and that said Letters Patent is hereby corrected as shown below:

Column 6, claim 1, line 20, insert --1 to-- in front of "120"
line 21, insert --1 to-- in front of "100"
line 22, insert --5 to-- in front of "450".

Column 6, claim 2, line 31, insert --5 to-- in front of "60"
line 32, insert --5 to-- in front of "20"
line 33, insert --5 to-- in front of "200".

Signed and Sealed this

Thirtieth Day of September, 1997

*Attest:*

Bruce Lehman

BRUCE LEHMAN

*Attesting Officer*

*Commissioner of Patents and Trademarks*